US009776406B2

(12) United States Patent
Zou et al.

(10) Patent No.: US 9,776,406 B2
(45) Date of Patent: Oct. 3, 2017

(54) METHOD FOR MANUFACTURING INK JET HEAD

(71) Applicants: DALIAN UNIVERSITY OF TECHNOLOGY, Dalian (CN); ZHUHAI SEINE TECHNOLOGY CO., LTD., Zhuhai (CN)

(72) Inventors: Helin Zou, Dalian (CN); Sha Sun, Zhuhai (CN); Yi Zhou, Zhuhai (CN)

(73) Assignees: DALIAN UNIVERSITY OF TECHNOLOGY, Liaoning (CN); ZHUHAI SEINE TECHNOLOGY CO., LTD., Guangdong (CN)

( * ) Notice: Subject to any disclaimer, the term of this patent is extended or adjusted under 35 U.S.C. 154(b) by 0 days.

(21) Appl. No.: 15/046,361

(22) Filed: Feb. 17, 2016

(65) Prior Publication Data

US 2016/0159096 A1 Jun. 9, 2016

Related U.S. Application Data

(63) Continuation of application No. PCT/CN2014/084095, filed on Aug. 11, 2014.

(30) Foreign Application Priority Data

Sep. 17, 2013 (CN) ..... 2013 1 0425684

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1626* (2013.01);
(Continued)

(58) Field of Classification Search
CPC ..... B41J 2/14233; B41J 2/161; B41J 2/1623; B41J 2/1626; B41J 2/1631; B41J 2/1639;
(Continued)

(56) References Cited

U.S. PATENT DOCUMENTS

2003/0184619 A1 10/2003 Lin et al. ..... 347/68
2004/0104975 A1 6/2004 Furuhata ..... 347/68
(Continued)

FOREIGN PATENT DOCUMENTS

CN 1521000 A 8/2004
CN 1611361 A 5/2005
(Continued)

OTHER PUBLICATIONS

International Search Report of corresponding International PCT Application No. PCT/CN2014/084095, dated Nov. 4, 2014.
(Continued)

*Primary Examiner* — A. Dexter Tugbang
(74) *Attorney, Agent, or Firm* — J.C. Patents

(57) ABSTRACT

Provided are a method for manufacturing an ink jet head and an ink jet head. The method includes: arranging a vibrating plate on lower surface of a substrate; arranging a piezoelectric actuator on surface of the vibrating plate; arranging a protective film on surface of the piezoelectric actuator for sealing the piezoelectric actuator along with the vibrating plate, thus preventing the piezoelectric actuator from corrosion; etching the substrate and the vibrating plate to form a groove on the substrate at a position corresponding to the piezoelectric actuator, and form a liquid feeding hole on the substrate and vibrating plate; forming a pressure chamber and a nozzle orifice on lower surface of the vibrating plate, allowing the pressure chamber to cover the position where the piezoelectric actuator is arranged in the vibrating plate,
(Continued)

enabling communication of the pressure chamber with the nozzle orifice and the liquid feeding hole.

12 Claims, 6 Drawing Sheets

(52) U.S. Cl.
CPC ..... *B41J 2/1631* (2013.01); *B41J 2/1639* (2013.01); *B41J 2/1642* (2013.01); *B41J 2/1646* (2013.01); *B41J 2002/1437* (2013.01); *B41J 2002/14241* (2013.01); *Y10T 29/42* (2015.01); *Y10T 29/49083* (2015.01); *Y10T 29/49401* (2015.01)

(58) Field of Classification Search
CPC ..... B41J 2/1642; B41J 2/1646; B41J 2002/14241; B41J 2002/1437; Y10T 29/42; Y10T 29/49083; Y10T 29/49401
See application file for complete search history.

(56) References Cited

U.S. PATENT DOCUMENTS

| | | | | |
|---|---|---|---|---|
| 2006/0027529 | A1* | 2/2006 | Tokunaga | B41J 2/161 216/27 |
| 2007/0052764 | A1* | 3/2007 | Oku | B41J 2/1623 347/68 |
| 2008/0158305 | A1 | 7/2008 | Cha et al. | 347/68 |
| 2010/0165044 | A1* | 7/2010 | Park | B41J 2/1631 347/40 |
| 2010/0231659 | A1 | 9/2010 | Ohta | 347/71 |
| 2011/0310181 | A1* | 12/2011 | Curcio | Y10T 29/49401 347/54 |

FOREIGN PATENT DOCUMENTS

| | | | | |
|---|---|---|---|---|
| CN | 1308144 | C | | 4/2007 |
| CN | 101037045 | A | | 9/2007 |
| CN | 103072378 | A | | 5/2013 |
| CN | 103085479 | A | | 5/2013 |
| CN | 103182844 | A | | 7/2013 |
| CN | 103252996 | A | | 8/2013 |
| CN | 103252997 | A | | 8/2013 |
| JP | 2003-118128 | A | | 4/2003 |
| JP | 2004-34554 | A | | 2/2004 |
| JP | 2004-209875 | A | | 7/2004 |
| JP | 2006-069204 | A | | 3/2006 |
| JP | 2006123212 | A | * | 5/2006 |
| JP | 2008-087478 | A | | 4/2008 |
| JP | 2009-544503 | A | | 12/2009 |
| JP | 2010-201940 | A | | 9/2010 |
| JP | 2011-37055 | A | | 2/2011 |
| JP | 2012-126107 | A | | 7/2012 |
| JP | 2012-126107 | A5 | | 2/2014 |

OTHER PUBLICATIONS

Chinese First Examination Report of corresponding China patent application No. 201310425684.5, dated Oct. 30, 2015.
The Japanese Examination Report of corresponding Japan patent application No. 2016-541782, dated Apr. 4, 2017.

* cited by examiner

METHOD FOR MANUFACTURING INK JET HEAD

CROSS-REFERENCE TO RELATED APPLICATIONS

This application is a continuation of International Application No. PCT/CN2014/084095, filed on Aug. 11, 2014, which claims priority to Chinese Patent Application No. 201310425684.5, filed on Sep. 17, 2013, both of which are hereby incorporated by reference in their entireties.

TECHNICAL FIELD

The invention relates to the technology of printing device, in particular, to a method for manufacturing ink jet head and an ink jet head.

BACKGROUND

Ink jet printing head is a device for printing images with predetermined colors by means of ejecting a small amount of ink droplets at required spots on a recording plate. The ink jet printing head can be driven by either of the two methods: by thermal driven, wherein the ink droplets are ejected under expansion force of air bubbles generated in the ink heated by a heat source; or by pressure applied on the ink by the ink jet printing head through deformation of a piezoelectric, so as to eject ink droplets.

A complex and precise ink flowing path is indispensable in the piezoelectric ink jet printing head. A manufacturing method of ink jet head is disclosed in Chinese patent No. CN200410031366.1, wherein a pressure chamber and a nozzle plate are first formed on a silicon substrate, and a resist layer is arranged to protect the pressure chamber and a nozzle orifice, then the silicon substrate is etched for forming a liquid feeding channel, and finally the resist layer is removed. The process requires a complicated process, numerous steps and may cause damage to the pressure chamber and the nozzle orifice during the removal of the resist layer.

SUMMARY

The present invention provides a method for manufacturing an ink jet head and an ink jet head, aimed at simplifying the process steps and improving the rate of finished product of the ink jet head.

In one aspect, the invention provides a method for manufacturing an ink jet head, including:

providing a vibrating plate on a lower surface of a substrate;

arranging a piezoelectric actuator on a surface of the vibrating plate;

and providing a protective film on a surface of the piezoelectric actuator for sealing the piezoelectric actuator along with the vibrating plate, thereby preventing corrosion of the piezoelectric actuator;

etching the substrate and the vibrating plate, so as to form a groove on the substrate at a position corresponding to the piezoelectric actuator, and to form a liquid feeding hole on both the substrate and the vibrating plate; and forming a pressure chamber and a nozzle orifice on a lower surface of the vibrating plate, allowing communication of the pressure chamber with the nozzle orifice and the liquid feeding hole.

In another aspect, the invention provides an ink jet head, including:

a vibrating plate, wherein a piezoelectric actuator is arranged on the surface of the vibrating plate, a protective film is arranged on the surface of the piezoelectric actuator for sealing the piezoelectric actuator along with the vibrating plate, thereby preventing corrosion of the piezoelectric actuator;

a pressure chamber, arranged on the lower surface of the vibrating plate and covers the position wherein the piezoelectric actuator in the vibrating plate is arranged, a nozzle orifice in communication with the pressure chamber is formed on the lower surface of the pressure chamber; and a substrate, located on the upper surface of the vibrating plate and is provided with a groove at the position corresponding to the piezoelectric actuator, a liquid feeding hole is formed on both the substrate and the vibrating plate and is communicated with the pressure chamber.

To sum up, the method for manufacturing an ink jet head provided by the present invention can guarantee that the piezoelectric actuator is free from corrosion during the subsequent etching process of the substrate and the vibrating plate by arranging a protective film on the surface of the piezoelectric actuator for sealing the piezoelectric actuator along with the vibrating plate. Besides, the method adopts the manufacturing process of etching the substrate and the vibrating plate prior to forming the pressure chamber and the nozzle orifice, so that there is no need to provide the resist layer, which otherwise is required to be removed, on the pressure chamber and the nozzle orifice during the formation of the pressure chamber, thus simplifying the technical process. Meanwhile, since the removal step of the resist layer is omitted, the nozzle plate and the nozzle orifice are not susceptible to be damaged during the manufacturing process, thereby improving the rate of the finished products.

| Reference Signs: | | |
|---|---|---|
| 201: substrate; | 202: vibrating plate; | 203: piezoelectric actuator; |
| 204: protective film; | 205: groove; | 206: liquid feeding hole; |
| 207: pressure chamber; | 208: nozzle orifice; | 209: pressure chamber layer; |
| 210: nozzle plate layer; | 211: cover plate; | 301: first mask; |
| 302: second mask. | | |

DESCRIPTION OF EMBODIMENTS

Figure 1:
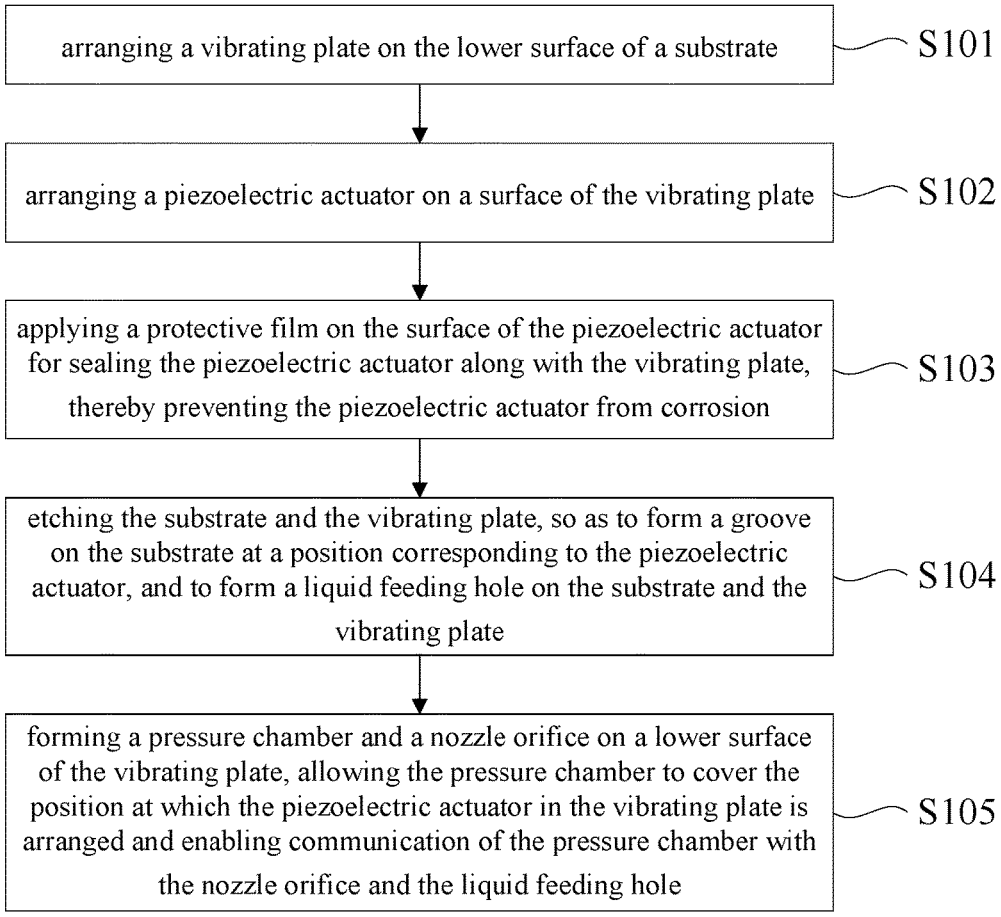
FIG. 1 is a flow chart of a method for manufacturing an ink jet head provided by an embodiment of the present invention.
Figure 2:
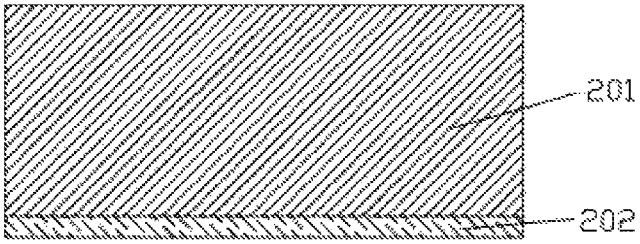
FIG. 2-FIG. 11 are schematic diagrams of steps of the method for manufacturing an ink jet head provided by an embodiment of the present invention.

As shown in FIG. 1, a method for manufacturing an ink jet head provided by an embodiment of the present invention includes the following steps:

Step S101 (as shown in FIG. 2): arranging a vibrating plate 202 on the lower surface of a substrate 201.

Preferably, the vibrating plate 202 is made of silicon nitride material so as to improve its elasticity, thus improving the vibration effect. Certainly the vibrating plate 202 can also be made of silicon oxide or zirconium oxide.

Figure 3:
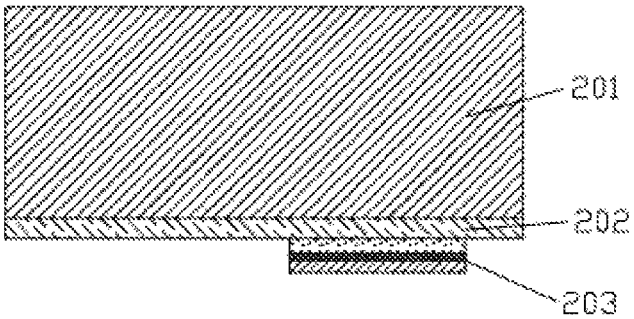

Step S102 (as shown in FIG. 3): arranging a piezoelectric actuator 203 on a surface of the vibrating plate 202.

The piezoelectric actuator 203 may include piezoelectric ceramic, an upper electrode and a lower electrode, wherein the piezoelectric actuator 203 acts as a driving element for converting applied voltage into mechanical energy, so as to drive the vibrating plate 202 to move upwards and downwards, which changes the volume of a pressure chamber which is to be formed in the subsequent step, thereby squeezing the ink out of a nozzle orifice which is to be formed in subsequent steps.

Preferably, the piezoelectric actuator 203 is arranged on the lower surface of the vibrating plate 202, thus allowing the piezoelectric actuator 203 to be positioned in the pressure chamber which is to be formed in the subsequent step, thereby improving vibration effect.

Figure 4:
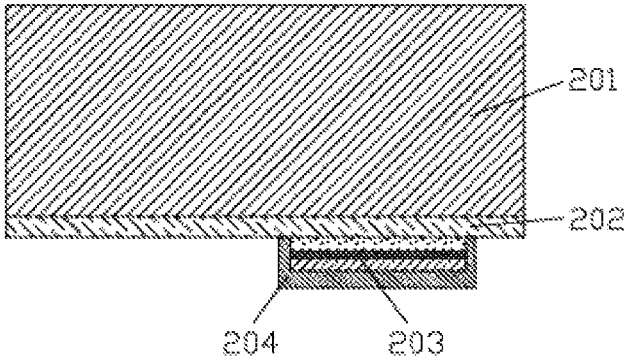

Step S103 (as shown in FIG. 4): applying a protective film 204 on the surface of the piezoelectric actuator 203 for sealing the piezoelectric actuator 203 along with the vibrating plate 202, thereby preventing the piezoelectric actuator 203 from corrosion;

The piezoelectric actuator 203 is guaranteed against corrosion during the subsequent etching process of the substrate 201 and the vibrating plate 202 as well as corrosion caused by prolonged soaking in the ink, due to application of the protective film 204 on the surface of the piezoelectric actuator 203 for sealing the piezoelectric actuator 203 along with the vibrating plate 202.

Preferably, the protective film 204 is made of silicon nitride or silicon oxide material for optimizing the corrosion resistance thereof. Also, because of hardness of the silicon nitride or silicon oxide material, the piezoelectric actuator 203 can vibrate when being positioned in the pressure chamber to be formed in the subsequent process, which improves vibration effect, wherein the protective film 204 can be obtained via a sputtering process or a chemical vapor deposition process.

Figure 5:
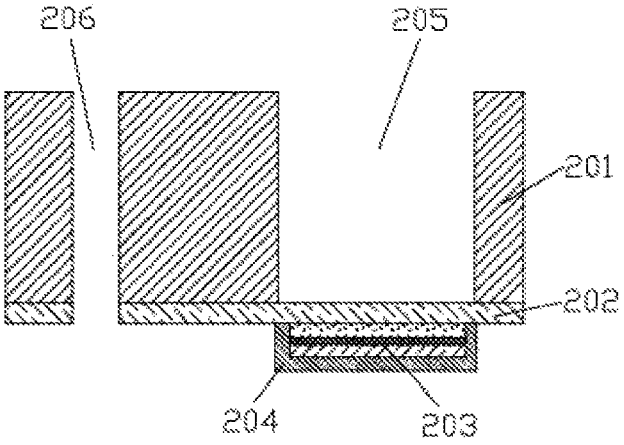

Step S104 (as shown in FIG. 5): etching the substrate 201 and the vibrating plate 202, so as to form a groove 205 on the substrate 201 at a position corresponding to the piezoelectric actuator 203, and to form a liquid feeding hole 206 on the substrate 201 and the vibrating plate 202.

The etching process causes no corrosion to the piezoelectric actuator 203 sealed by both the protective film 204 and the vibrating plate 202. The groove 205 is formed on the substrate 201 at a position corresponding to the piezoelectric actuator 203, so that the vibrating plate 202 can bulge towards the groove 205 when being driven to vibrate by the piezoelectric actuator 203, thereby increasing the vibration space and improving the vibration effect of the vibrating plate 202. Meanwhile, the volume of the pressure chamber to be formed in the subsequent process is enlarged when the vibrating plate 202 bulges towards the groove 205, drawing more ink into the pressure chamber, thus guaranteeing the quantity of the ink to be ejected. And the liquid feeding hole 206 is formed on the substrate 201 and the vibrating plate 202 for allowing the ink to flow in.

Figure 10:
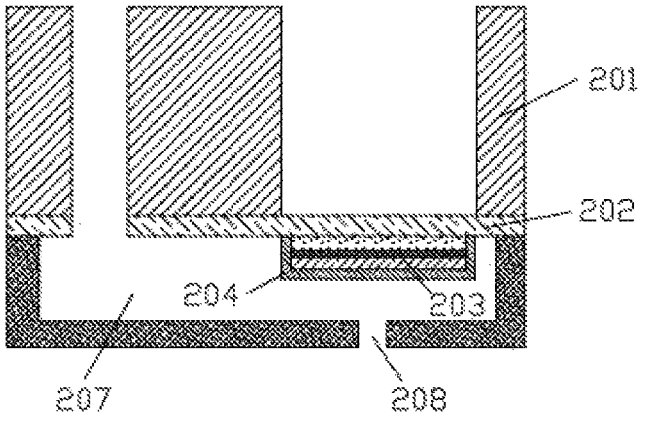

Step S105 (as shown in FIG. 10): forming a pressure chamber 207 and a nozzle orifice 208 on a lower surface of the vibrating plate 202, allowing the pressure chamber 207 to cover the position at which the piezoelectric actuator 203 in the vibrating plate 202 is arranged and enabling communication of the pressure chamber 207 with the nozzle orifice 208 and the liquid feeding hole 206.

Since the pressure chamber 207 is communicated with the nozzle orifice 208 and the liquid feeding hole 206, the ink flows from the liquid feeding hole 206 into the pressure chamber 207, from which the ink is ejected through the nozzle orifice 208 when the piezoelectric actuator 203 drives the vibrating plate 202 to vibrate.

The method adopts the manufacturing process of etching the substrate 201 and the vibrating plate 202 prior to forming the pressure chamber 207 and the nozzle orifice 208, so that there is no need to provide the resist layer, which otherwise is required to be removed, on the pressure chamber 207 and the nozzle orifice 208 during the formation of the pressure chamber 207, thus simplifying the technical process. Meanwhile, since the removal step of the resist layer is omitted, the nozzle plate and the nozzle orifice are not susceptible to be damaged during the manufacturing process, thereby improving the rate of the finished products.

Preferably, step S105 includes steps S106-S110.

Figure 6:
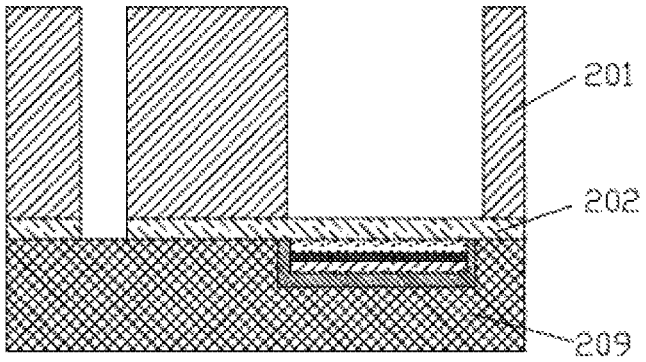

Step S106 (as shown in FIG. 6): forming a pressure chamber layer 209 on the lower surface of the vibrating plate 202.

Preferably, the pressure chamber layer 209 can be made of SU8 photoresist in order to form tighter bonding with the vibrating plate 202 so as to secure the connection of a pressure chamber 207 to be subsequently formed more firmly, and definitely the pressure chamber layer 209 can also be made of other photoresists, for which the present invention does not make any specific restrictions.

Figure 7:
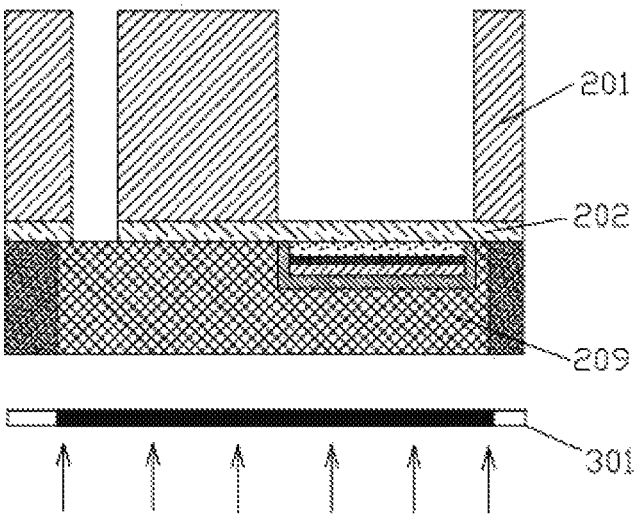

Step S107 (as shown in FIG. 7): exposing via a first mask 301 to cure the side walls of the pressure chamber layer 209.

Figure 8:
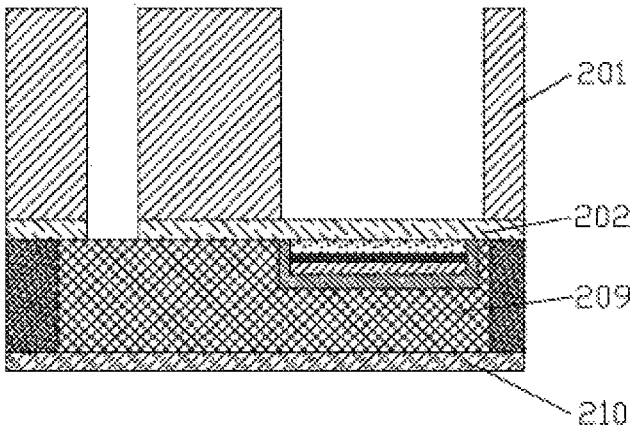

Step S108 (as shown in FIG. 8): arranging a nozzle plate layer 210 on the lower surface of the pressure chamber layer 209.

Preferably, the nozzle plate layer 210 can be made of SU8 photoresist in order to form tighter bonding with the pressure chamber layer 209 so as to secure the connection of the nozzle plate to be subsequently formed more firmly, and definitely the nozzle plate layer 210 can also be made of other photoresists, for which the present invention does not make any specific restrictions.

Figure 9:
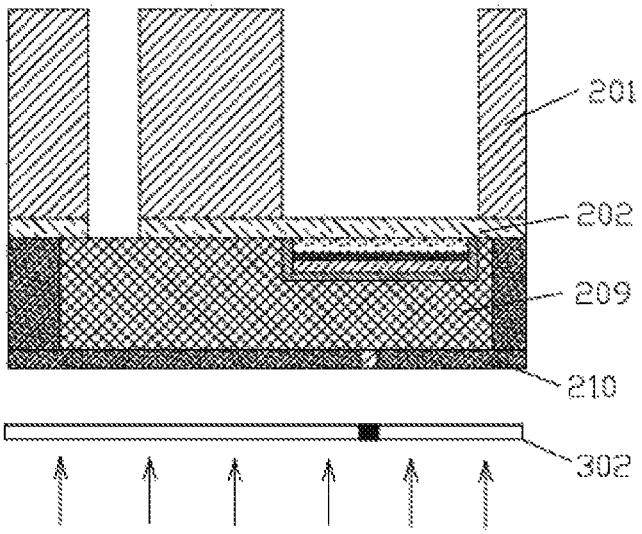

Step S109 (as shown in FIG. 9): preferably, exposing via a second mask 302 to cure the nozzle plate layer 210 except for the position of the nozzle orifice 208.

Step S110 (as shown in FIG. 10): performing development to form the pressure chamber 207 and the nozzle orifice 208, allowing the pressure chamber 207 to be communicated with the nozzle orifice 208 and the liquid feeding hole 206.

Through developing, the parts of the pressure chamber layer 209 and the nozzle plate layer 210, which are not cured in the exposing process, are removed, thereby forming the pressure chamber layer 209 and the nozzle orifice 208.

In the present embodiment, high quality product is obtained by forming the pressure chamber layer 209 and the nozzle orifice 208 by means of an optical method, and obviously the pressure chamber layer 209 and the nozzle orifice 208 can also be formed via laser processing, mechanical blasting or a chemical method, for which the present invention does not make any specific limits.

Preferably, the pressure chamber 207 and the nozzle orifice 208 are formed on the lower surface of the vibrating plate 202, and a step 111 is further carried out after the pressure chamber 207 is communicated with the nozzle orifice 208 and the liquid feeding hole 206.

Figure 11:
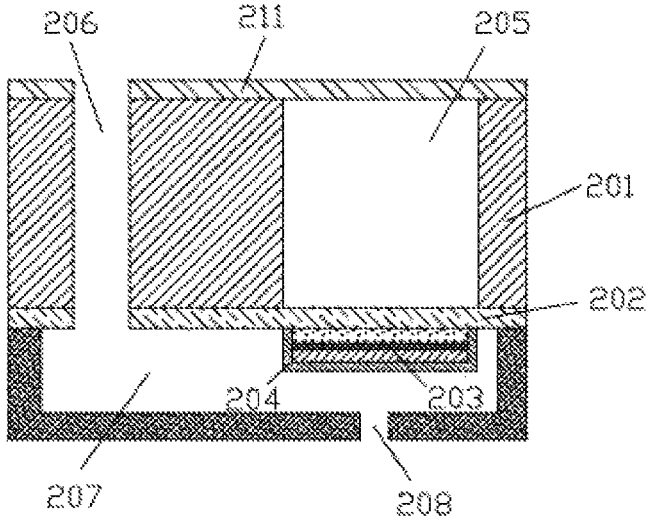

Step S111 (as shown in FIG. 11): providing a cover plate 211 on the upper surface of the substrate 201, wherein the cover plate 211 is provided with an opening which is communicated with the liquid feeding hole 206, so as to obtain a finished product of the ink jet head.

In the method for manufacturing an ink jet head provided by the embodiment of the present invention, the liquid feeding hole 206 takes is formed by an etching process, while the pressure chamber layer 209 and the nozzle orifice 208 are formed by means of an optical method, thereby avoiding the use of adhesive and a further problem of the liquid feeding hole 206 and the nozzle orifice 208 being clogged by the adhesive.

As shown in FIG. 11, the ink jet head provided by the embodiment of the present invention includes: a vibrating plate 202, wherein a piezoelectric actuator 203 is arranged on the surface of the vibrating plate 202, and a protective film 204 is arranged on the surface of the piezoelectric actuator 203 for sealing the piezoelectric actuator 203 along with the vibrating plate 202 for preventing corrosion thereof; a pressure chamber 207, wherein the pressure chamber is arranged on the lower surface of the vibrating plate 202 and covers the position where the piezoelectric actuator 203 in the vibrating plate 202 is placed, and a nozzle orifice 208 in communication with the pressure chamber 207 is formed on the lower surface of the pressure chamber 207; a substrate 201, wherein the substrate 201 is located on the upper surface of the vibrating plate 202 and is provided with a groove 205 at the position corresponding to the piezoelectric actuator 203, a liquid feeding hole 206 is formed on both the substrate 201 and the vibrating plate 202 and is communicated with the pressure chamber 207; and a cover plate 211 which is arranged on the upper surface of the substrate 201 and provided with an opening which is communicated with the liquid feeding hole 206.

In the present embodiment, since the protective film 204 is arranged on the surface of the piezoelectric actuator 203 for sealing the piezoelectric actuator 203 along with the vibrating plate 202, therefore, the piezoelectric actuator 203 avoids being corroded during the etching process of the substrate 201 and the vibrating plate 202. As a result, in the manufacturing process of the ink jet head, it can be realized that the process of etching the substrate 201 and the vibrating plate 202 prior to formation of the pressure chamber 207 and the nozzle orifice 208, so that there is no need to provide the resist layer, which otherwise is required to be removed, on the pressure chamber 207 and the nozzle orifice 208 during the formation of the pressure chamber 207, thus simplifying the technical process. Meanwhile, the piezoelectric actuator 203 is free from corrosion caused by long time soaking in the ink.

In the present embodiment, preferably, the piezoelectric actuator 203 is arranged on the lower surface of the vibrating plate 202, thus the piezoelectric actuator 203 can be positioned in the pressure chamber 207, thereby improving the vibration effect.

In the present embodiment, preferably, the protective film 204 is made of silicon nitride or silicon oxide material for optimizing corrosion resistance of the protective film 204. Also, because of hardness of the silicon nitride or silicon oxide material, the piezoelectric actuator 203 can vibrate when being positioned in the pressure chamber 207, which improves the vibration effect.

In the present embodiment, preferably, the vibrating plate 202 is made of silicon nitride material in order to improve elasticity thereof, thereby improving the vibration effect. There is no doubt that the vibrating plate 202 can also be made of silicon oxide or laminated material of zirconium oxide and silicon oxide.

Finally, it should be stated that the above embodiments are only used to demonstrate rather than limit the technical schemes of the present invention; and concrete as the description in the aforementioned embodiments of the invention is, it should be understood by the those skilled in the art that various modifications can be made to the technical schemes recorded in the aforesaid embodiments, or that equivalents and the like can be employed to replace partial or all of the technical characteristics therein; and neither the modifications nor the replacements are considered to render the essence of the corresponding technical schemes departing from the scope defined by the technical schemes demonstrated in the aforesaid embodiments of the present invention.

What is claimed is:

1. A method for manufacturing an ink jet head, comprising:

arranging a vibrating plate on a lower surface of a substrate;

arranging a piezoelectric actuator on a surface of the vibrating plate;

arranging a protective film on a surface of the piezoelectric actuator for sealing the piezoelectric actuator along with the vibrating plate, so as to prevent the piezoelectric actuator from corrosion;

etching the substrate and the vibrating plate, so as to form a groove on the substrate at a position corresponding to the piezoelectric actuator, and to form a liquid feeding hole on both the substrate and the vibrating plate; and after the groove and the liquid feeding hole are formed, forming a pressure chamber and a nozzle orifice on a lower surface of the vibrating plate, allowing the pressure chamber to cover a position at which the piezoelectric actuator is arranged in the vibrating plate and enabling communication of the pressure chamber with the nozzle orifice and the liquid feeding hole.

2. The method for manufacturing an ink jet head according to claim 1, wherein the arranging the piezoelectric actuator on the surface of the vibrating plate comprises:

arranging the piezoelectric actuator on the lower surface of the vibrating plate.

3. The method for manufacturing an ink jet head according to claim 2, wherein the protective film is made of silicon nitride or silicon oxide material.

4. The method for manufacturing an ink jet head according to claim 2, wherein the vibrating plate is made of silicon nitride.

5. The method for manufacturing an ink jet head according to claim 2, wherein the forming the pressure chamber and the nozzle orifice on the lower surface of the vibrating plate, allowing the pressure chamber to cover the position at which the piezoelectric actuator is arranged in the vibrating plate and enabling communication of the pressure chamber with the liquid feeding hole and the liquid feed hole comprises:

forming a pressure chamber layer on the lower surface of the vibrating plate;

exposing via a first mask to cure side walls of the pressure chamber layer;

arranging a nozzle plate layer on a lower surface of the pressure chamber;

exposing via a second mask to cure the nozzle plate layer except for the position of the nozzle orifice; and developing to form the pressure chamber and the nozzle orifice, allowing the pressure chamber to be communicated with the nozzle orifice and the liquid feeding hole.

6. The method for manufacturing an ink jet head according to claim 5, wherein the pressure chamber layer and the nozzle plate layer are made of SU8 photoresist.

7. The method for manufacturing an ink jet head according to claim 2, further comprising:

arranging a cover plate on an upper surface of the substrate after forming the pressure chamber and the nozzle orifice on the lower surface of the vibration plate, wherein the cover plate is provided with an opening which is communicated with the liquid feeding hole.

8. The method for manufacturing an ink jet head according to claim 1, wherein the protective film is made of silicon nitride or silicon oxide material.

9. The method for manufacturing an ink jet head according to claim 1, wherein the vibrating plate is made of silicon nitride.

10. The method for manufacturing an ink jet head according to claim 1, wherein the forming the pressure chamber and the nozzle orifice on the lower surface of the vibrating plate, allowing the pressure chamber to cover the position at which the piezoelectric actuator is arranged in the vibrating plate and enabling communication of the pressure chamber with the liquid feeding hole and the liquid feed hole comprises:

forming a pressure chamber layer on the lower surface of the vibrating plate;

exposing via a first mask to cure side walls of the pressure chamber layer;

arranging a nozzle plate layer on a lower surface of the pressure chamber;

exposing via a second mask to cure the nozzle plate layer except for the position of the nozzle orifice; and developing to form the pressure chamber and the nozzle orifice, allowing the pressure chamber to be communicated with the nozzle orifice and the liquid feeding hole.

11. The method for manufacturing an ink jet head according to claim 10, wherein the pressure chamber layer and the nozzle plate layer are made of SU8 photoresist.

12. The method for manufacturing an ink jet head according to claim 1, further comprising:

arranging a cover plate on an upper surface of the substrate after forming the pressure chamber and the nozzle orifice on the lower surface of the vibration plate, wherein the cover plate is provided with an opening which is communicated with the liquid feeding hole.

* * * * *